United States Patent [19]

Nei et al.

[11] 4,021,234

[45] May 3, 1977

[54] METHOD FOR REMOVING IMPURITIES IN LIQUID METAL

[75] Inventors: Hiromichi Nei, Yokohama; Koh Hashiguchi, Oarai, both of Japan

[73] Assignee: Doryokuro Kakunenryo Kaihatsu Jigyodan, Tokyo, Japan

[22] Filed: Nov. 6, 1975

[21] Appl. No.: 629,814

[30] Foreign Application Priority Data

Nov. 14, 1974 Japan ..... 49-130433

[52] U.S. Cl. ..... 75/66; 75/63; 423/646

[51] Int. Cl.[2] ..... C22B 26/10; C01B 6/04

[58] Field of Search ..... 75/63, 66; 423/646, 423/647

[56] References Cited

UNITED STATES PATENTS 2,866,702 12/1958 Batutis ..... 75/66
2,879,157 3/1959 Batutis ..... 76/66
3,243,280 3/1966 Bohlmann ..... 75/66

*Primary Examiner*—P. D. Rosenberg
*Attorney, Agent, or Firm*—Wenderoth, Lind & Ponack

[57] ABSTRACT

A method and an apparatus for removing hydrogen and other impurities contained in liquid metal. The liquid metal containing hydrogen and other impurities is cooled below their saturation temperature to precipitate hydrogen and other impurities in the form of various compounds of the metal, and the precipitate is trapped and accumulated. The thus accumulated precipitate is then dissolved in a small amount of liquid metal having a temperature at least above said saturation temperature to produce high temperature liquid metal having a high hydrogen concentration. The high temperature liquid metal is contacted with one side of a metal membrane having a hydrogen permeability, another side of which being at reduced pressure, thereby selectively removing hydrogen in gaseous state from the liquid metal.

12 Claims, 1 Drawing Figure

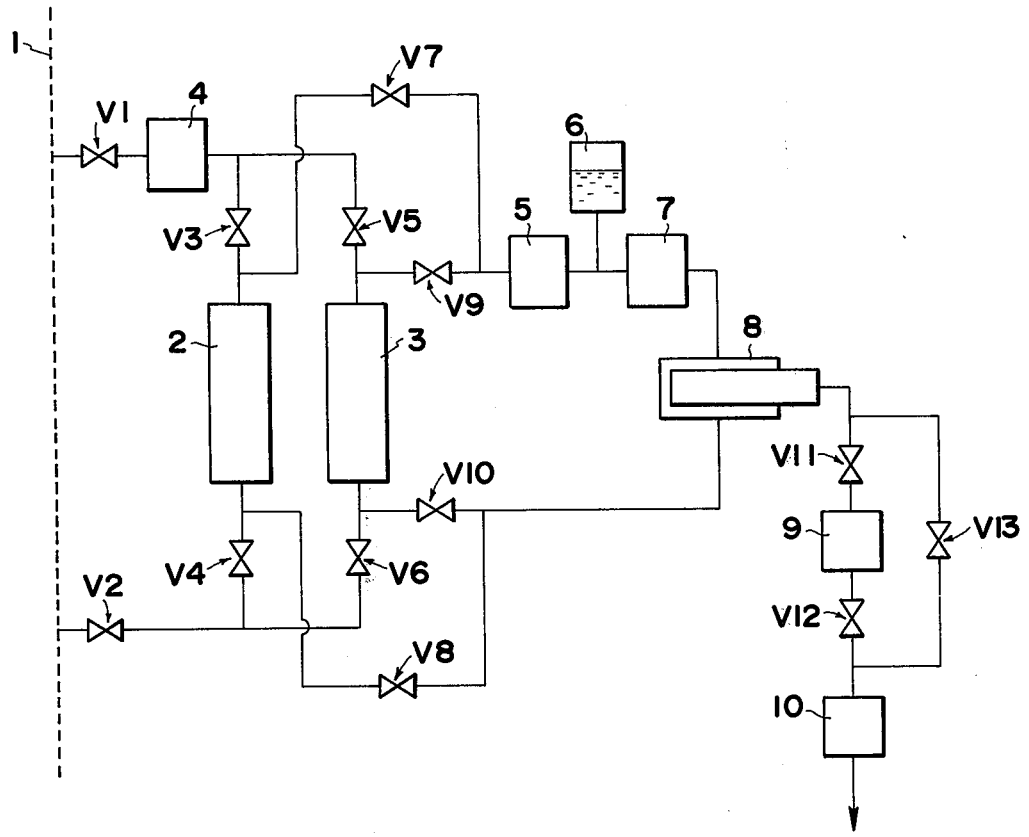
1
V1
4
V7
6
V3
V5
5
7
V9
2
3
8
V10
V11
9
V13
V4
V6
V2
V12
V8
10

METHOD FOR REMOVING IMPURITIES IN LIQUID METAL

BACKGROUND OF THE INVENTION

This invention relates generally to removing impurities in liquid metal such as liquid sodium, and more particularly to a method and an apparatus for efficiently removing impurities in liquid sodium coolant used in a nuclear reactor.

Various impurities such as hydrogen, oxygen, nitrogen, carbon, metallic impurities and the like are contained in liquid metal coolant used in a secondary system or an experimental loop for a fast breeder reactor.

In order to remove such impurities contained in the liquid sodium, there has been used hitherto a cold trap in which the liquid metal is cooled below the saturation temperature of the impurities to be removed thereby precipitating the impurities in the form of various sodium compounds from the liquid sodium. The thus produced precipitate is trapped and accumulated in the cold trap by using, for example, wire gauzes of stainless steel. However, it is pointed out by recent reports that, when hydrogen gas is produced due to a hydrogen diffusion resulted from the corrosion of a heat transfer tube wall in a steam generator, a large quantity of precipitate, such as hydrides of sodium and the like which is especially originated from hydrogen impurity, is separated in the cold trap and such precipitate plugs the cold trap within a period of one or two years. Therefore, it is desirable to remove the impurities, especially hydrogen contained in the liquid metal.

With respect to the removal of hydrogen gas from the liquid metal, it is usually known that hydrogen can permeate through a membrane of nickel, iron or stainless steel which has a corrosion resistance against the liquid metal. Therefore, by providing such metal membrane in a stream path of the liquid metal directly branched from the secondary system or the experimental loop of the reactor and by contacting the liquid metal containing hydrogen impurity with one side of the metal membrane and reducing the pressure of the opposite side of the metal membrane, the hydrogen impurity can selectively permeate in gaseous state through the membrane and can be removed from the liquid metal. Such hydrogen removing system using the metal membrane as described above, however, has been used mainly for determining a hydrogen concentration in the liquid sodium thereby detecting the water leak. For this purpose, it is preferable to maintain the hydrogen concentration in the liquid sodium considerably low (for example about 150° C, when indicated by the saturation temperature of hydrogen) in order to increase the detection sensitivity as much as possible. On the contrary, it is not effective for the purpose of the removal of hydrogen from the liquid sodium to carry out the permeation of hydrogen through the metal membrane under such low saturation temperature. In order to remove a considerable amount of hydrogen from the liquid sodium, a vast area of the metal membrane is required.

OBJECTS AND BRIEF SUMMARY OF THE INVENTION

Therefore, it is an object of this invention to provide a new and improved method and apparatus for efficiently removing impurities in liquid metal.

It is another object of this invention to provide a method and apparatus for removing impurities contained in liquid metal, especially removing hydrogen which becomes the largest cause for plugging a cold trap.

It is a further object of this invention to provide a method for removing impurities, especially hydrogen, from liquid metal with a use of relatively small area of a metal membrane which has a hydrogen permeability.

It is a further object of this invention to provide a compact apparatus for efficiently removing impurities, especially hydrogen, from liquid metal.

In accordance with the method of the present invention, liquid metal containing hydrogen and other impurities, which is derived, for example, from a secondary system or an experimental loop of a fast breeder, is cooled below their saturation temperature to precipitate hydrogen and other impurities in the form of various compounds of the metal, and the precipitate is trapped and accumulated. The thus accumulated precipitate is then dissolved in a small amount of liquid metal having a temperature at least above said saturation temperature to produce high temperature liquid metal having a high hydrogen concentration. The high temperature liquid metal is contacted with one side of a metal membrane having a hydrogen permeability, another side of which being at reduced pressure, to thereby selectively remove hydrogen in gaseous state from the liquid metal.

The apparatus according to the present invention comprises means for cooling the liquid metal containing hydrogen and other impurities to thereby precipitate the impurities and trapping and accumulating the precipitate, and hydrogen removing means composed of a metal membrane having a hydrogen permeability. One side of the metal membrane is at reduced pressure. The apparatus further comprises a stream path in which high temperature liquid metal is flowed. The stream path is adapted to flow the high temperature liquid metal into the cooling, trapping and accumulating means thereby dissolving the accumulated precipitate, and then into another side of the metal membrane opposite to the pressure-reduced side of the hydrogen-removing means thereby removing hydrogen in gaseous state. Valve means is also provided for switching the flow of the high temperature liquid metal so as to flow the high temperature liquid metal into the cooling, trapping and accumulating means after accumulating the precipitate therein is accomplished and not to flow during accumulating.

Other objects and advantages of the present invention will become apparent upon reading the following description and upon reference to the accompanying drawing.

BRIEF DESCRIPTION OF THE DRAWING

The drawing is a schematic diagram illustrating a preferred embodiment of this invention.

DETAILED DESCRIPTION OF THE INVENTION

It has been generally considered that impurities in liquid metal are hydrogen, oxygen, nitrogen, carbon, metals and the like. These impurities can be removed by using a cold trap of a conventional type. However, it is required to remove especially hydrogen impurity, since a large quantity of precipitate resulted from hydrogen impurity is separated in the cold trap and becomes the largest cause for plugging the cold trap.

When hydrogen is removed in gaseous state by using a hydrogen-permeable metal membrane, an amount of hydrogen permeated through the metal membrane depends on the saturation temperature of hydrogen.

The relationship between the saturation temperature of hydrogen and the equilibrium pressure of hydrogen containing in liquid sodium is expressed in terms of the following equation:

$$\log P_H = -\frac{6400}{T} + 10.82 \quad (1)$$

wherein $P_H$; the equilibrium pressure of hydrogen in liquid sodium (cmHg), and T; the saturation temperature of hydrogen(° K).

On the other hand, when hydrogen permeates and diffuses through the metal membrane, the permeable amount of hydrogen can generally be represented by the following equation which is derived from Sievert's Law:

$$\phi = \frac{C(P_1^{1/2} - P_2^{1/2})}{x} \exp\left(-\frac{Q}{RT_M}\right) \quad (2)$$

wherein $\phi$; the permeable amount of hydrogen per unit area of the membrane (cc (s.t.p.)/cm$^2$.hr), C; a constant determined by the membrane used, $\chi$; the thickness of the membrane (mm), $P_1$; the equilibrium pressure of hydrogen in the sodium side (atm), $P_2$; the equilibrium pressure of hydrogen in the diffusion side (atm), Q; the activation energy (kcal/mol.°K), R; a gas constant (1,987 kcal/mol), and $T_M$; the membrane temperature (°K).

In the equation (2), $P_1$ equals to $P_H$, and $P_2$ is negligible since it is sufficiently smaller than the equilibrium pressure of hydrogen in the sodium side, so that the equation (2) can be put in the following equation by determining the membrane thickness, the membrane temperature and the kind of metal membrane:

$$\phi = K\, P_H^{1/2} \quad (3)$$

wherein K represents a constant determined by the membrane used.

Table 1 shows the practical equilibrium pressure of hydrogen in liquid sodium $P_H$ and the value of $P_H^{1/2}$ corresponding to respective saturation temperatures of hydrogen T.

Table 1.

| T (° C) | $P_H$ (atm) | $P_H^{1/2}$ |
|---|---|---|
| 100 | $6.04 \times 10^{-9}$ | $7.77 \times 10^{-5}$ |
| 200 | $2.56 \times 10^{-5}$ | $5.06 \times 10^{-3}$ |
| 300 | $5.89 \times 10^{-3}$ | $7.67 \times 10^{-2}$ |
| 400 | 0.269 | 0.519 |
| 500 | 4.57 | 2.14 |

It is apparent from Table 1 that the permeable amount of hydrogen per unit area of the membrane, which is proportional to $P_H^{1/2}$, increases with increasing the saturation temperature of hydrogen. That is to say, as the saturation temperature of hydrogen increases, the area of the metal membrane required to permeate a given amount of hydrogen decreases.

In order to demonstrate such relationship as described above, the required area of the metal membrane corresponding to respective saturation temperatures of hydrogen T was calculated assuming that the membrane was made of nickel; the thickness of membrane was 0.5 mm; the membrane temperature was 500° C; the amount of hydrogen diffusion from a heat transfer tube wall in a steam generator was $9.4 \chi 10^{-12}$ gH/cm$^2$.sec; and the total area of the pipe was 1030 m$^2$. The results are shown in Table 2.

Table 2.

| T (° C) | Area of membrane required (cm$^2$) |
|---|---|
| 100 | $1.552 \times 10^8$ |
| 150 | $1.52 \times 10^7$ |
| 200 | $2.383 \times 10^6$ |
| 300 | $1.572 \times 10^5$ |
| 400 | $2.33 \times 10^4$ |
| 500 | $5.65 \times 10^3$ |

As is evident from Table 2, the area of membrane required at the saturation temperature of 500° C is $1/10^3$ of the area required at the saturation temperature of 150° C.

Therefore, it produces a successful result for miniaturization of the hydrogen removing device utilizing the metal membrane to dissolve the precipitate once accumulated in a small amount of liquid sodium having a higher temperature than at least the saturation temperature applied in the cooling step and then contact the high temperature liquid sodium having a high hydrogen concentration with the metal membrane according to the present invention. Furthermore, such compact hydrogen removing device can remove hydrogen in liquid sodium so efficiently that the volume of the trapping and accumulating means can also advantageously be reduced.

In the cooling step, cooling is generally carried out up to about 150° C, preferably up to about 120° C, at which temperature hydrogen and other impurities in the liquid sodium are precipitated in the form of various sodium compounds.

In the dissolving step, it is preferred to use a small amount of liquid sodium having as high temperature as possible. This temperature may be determined by considering the corrosion resistance of the metal membrane used, and the degree of miniaturization of the device, etc. It has been found that a preferred temperature of the liquid sodium into which the precipitate is dissolved is about 500° C, when the membrane of nickel is used.

The attached drawing shows a preferred embodiment of the apparatus for conducting the method of this invention.

In a stream path of liquid sodium branched from the secondary system or the experimental loop 1 of the fast breeder, there are provided in parallel two cold traps 2 and 3. The liquid sodium containing hydrogen and other impurities is at first flowed into the cold trap 2 by openning valves V1, V2, V3 and V5 and by driving a liquid metal pump 4. Hydrogen and other impurities are separated in the form of various sodium compounds from the liquid sodium, and are trapped and accumulated as precipitate in the cold trap 2 in the same manner as in a conventional cold trap. The liquid sodium from which the impurities have been removed is returned to the secondary system 1 via valves V4 and V2.

When a sufficient amount of the precipitate of the impurities is accumulated in the cold trap 2, then the liquid sodium containing the impurities is in turn introduced to the cold trap 3 by closing valves V3 and V4 and opening valves V5 and V6. The cold traps 2 and 3 are thus alternately used.

The precipitate of the impurities accumulated in the cold trap 2 is then dissolved in a small amount of liquid sodium having a higher temperature than that of liquid sodium discharged from the cold trap 2. The high temperature liquid sodium is circulated, by opening valves V7 and V8, in a closed stream loop comprising the cold trap 2, a liquid metal pump 5, an expansion tank 6, a heater 7, a metal membrane device 8, and the cold trap 2. A hydrogen-removing device conventionally comprises the metal membrane device 8, a diffusion pump 9, a vacuum pump 10, and valves V11, V12, V13. The liquid sodium in this stream loop is circulated by the pump 5 and is heated up to the desired temperature by the heater 7. By introducing the thus circulated and heated liquid sodium into the cold trap 2, the once accumulated precipitate is dissolved in the heated liquid sodium to produce, if attention is payed to hydrogen, liquid sodium having a high hydrogen concentration. The expansion tank 6 is provided to allow the volume expansion of liquid sodium due to heating.

The high temperature liquid sodium dissolving therein the precipitate of impurities is then flowed into the metal membrane device 8, where the high temperature liquid sodium is contacted with one side of the metal membrane having a hydrogen permeability. The pressure of another side of the membrane is reduced by means of the diffusion pump 9 and the vacuum pump 10, so that hydrogen can selectively permeate in gaseous state through the membrane to the pressure-reduced side thereby removing hydrogen impurity from the liquid sodium.

The high temperature liquid sodium containing dissolved impurities other than hydrogen, such as oxygen, nitrogen, carbon, metal oxides and the like, is then returned to the cold trap 2, where the high temperature liquid sodium is cooled below the saturation temperature of the remaining dissolved impurities to separate and accumulate the precipitate of the remaining impurities in the cold trap 2. The amount of the thus accumulated precipitate of impurities other than hydrogen is small in comparison with that of the precipitate resulted from hydrogen. Therefore, the cold trap 2 can repeatedly be used for the subsequent trapping operations. When the precipitate accumulated in the cold trap 3 is dissolved, the high temperature liquid sodium is in turn flowed into the cold trap 3 by closing valves V7 and V8 and opening valves V9 and V10, thereby forming another closed stream loop comprising the cold trap 3, the liquid metal pump 5, the expansion tank 6, the heater 7, the metal membrane device 8, and the cold trap 3. The removal of hydrogen and the separation of impurities other than hydrogen can be conducted by repeating the same procedures as described above.

Although, in the preferred embodiment hereinbefore described, two cold traps arranged in parallel are used, single or more than two traps may be used. In addition, another cold trap may be connected to the metal membrane device so as to trap and accumulate impurities other than hydrogen in this cold trap. Furthermore, the cold trap in the embodiment may be replaced by a trap of other type such as precipitation type or filter type.

It will be understood that the present invention is not to be limited to the details given herein, but that it may be modified within the scope of the appended claims.

What is claimed is:

1. A method for removing hydrogen and other impurities contained in liquid metal comprising cooling the liquid metal containing hydrogen and other impurities below their saturation temperature to precipitate hydrogen and other impurities in the form of various compounds of the metal, trapping and accumulating the precipitate, dissolving the thus accumulated precipitate in a small amount of liquid metal having a temperature at least above said saturation temperature to produce a high temperature liquid metal having a high hydrogen concentration, contacting the high temperature liquid metal with one side of a metal membrane having hydrogen permeability, the other side of said metal membrane being at reduced pressure, thereby selectively removing hydrogen in a gaseous state from the liquid metal.

2. The method according to claim 1, wherein said metal membrane having a hydrogen permeability is a metal selected from the group consisting of nickel, iron and stainless steel.

3. The method according to claim 1, wherein the liquid metal containing hydrogen and other impurities is cooled up to about 120°–150° C, and the accumulated precipitate is dissolved in liquid metal having a temperature of about 500° C.

4. A method for removing hydrogen and other impurities contained in liquid metal comprising cooling the liquid metal containing hydrogen and other impurities below their saturation temperature to precipitate hydrogen and other impurities in the form of various compounds of the metal, trapping and accumulating the precipitate, dissolving the thus accumulated precipitate in a small amount of liquid metal having a temperature at least above said saturation temperature to produce a high temperature liquid metal having a high hydrogen concentration, contacting the high temperature liquid metal with one side of a metal membrane having hydrogen permeability, the other side of said metal membrane being at reduced pressure, thereby selectively removing hydrogen in a gaseous state from the liquid metal, cooling again the high temperature liquid metal containing dissolved impurities other than hydrogen below the saturation temperature of the dissolved impurities to precipitate the impurities, and trapping and accumulating the precipitate of impurities other than hydrogen.

5. The method according to claim 4, wherein said metal membrane having a hydrogen permeability is a metal selected from the group consisting of nickel, iron and stainless steel.

6. The method according to claim 4, wherein the liquid metal containing hydrogen and other impurities is cooled up to about 120°–150° C, and the accumulated precipitate is dissolved in liquid metal having a temperature of about 500° C.

7. The method according to claim 1, wherein the liquid metal is sodium.

8. The method according to claim 3, wherein the liquid metal is sodium.

9. The method according to claim 8, wherein the metal membrane having hydrogen permeability is a metal selected from the group consisting of nickel, iron and stainless steel.

10. The method according to claim 4, wherein the liquid metal is sodium.

11. The method according to claim 6, wherein the liquid metal is sodium.

12. The method according to claim 11, wherein the metal membrane having hydrogen permeability is a metal selected from the group consisting of nickel, iron and stainless steel.

* * * * *